United States Patent [19]

Brown

[11] Patent Number: 4,976,076

[45] Date of Patent: Dec. 11, 1990

[54] BUILDING STRUCTURE

[75] Inventor: Ronald L. Brown, Bournefields, United Kingdom

[73] Assignee: Finch Conservatories Limited, Southampton, United Kingdom

[21] Appl. No.: 392,102

[22] Filed: Aug. 10, 1989

[30] Foreign Application Priority Data

Aug. 10, 1988 [GB] United Kingdom ..... 8819006

[51] Int. Cl.[5] ..... E04B 7/02

[52] U.S. Cl. ..... 52/90; 52/92; 52/309.16

[58] Field of Search ..... 52/90, 92, 309.15, 309.16, 52/731

[56] References Cited

U.S. PATENT DOCUMENTS

| | | | |
|---|---|---|---|
| 3,470,598 | 10/1969 | Berthelsen | 52/309.16 X |
| 4,057,941 | 11/1977 | Schwartz | 52/92 X |
| 4,069,627 | 1/1978 | Pegg | 52/92 |
| 4,167,838 | 9/1979 | Metheny | 52/90 X |
| 4,205,497 | 6/1980 | Schirm | 52/731 X |
| 4,601,139 | 7/1986 | Esposito | 52/90 |
| 4,756,127 | 7/1988 | Helterbrand et al. | 52/92 X |

*Primary Examiner*—David A. Scherbel
*Assistant Examiner*—Creighton Smith
*Attorney, Agent, or Firm*—Cumpston & Shaw

[57] ABSTRACT

A building structure comprising spaced rows of upright frame members formed of metal reinforced uPVC extrustions each joined by an eaves beam, and a plurality of extruded roof bars connecting said rows, selected roof bars being metal reinforced, and means to connect together the frame members and selected roof bars so as to provide a rigid joint at each connection, thus providing a structure such as a conservatory with one or more Portal frames. The joints are preferably bolted with at least two bolts, and the roof bars are of inverted U-shape, and a metal ridge bar interconnecting their apices; preferably projections on the ridge bar extend into the members of the roof bars and are bolted to the metal reinforcement. Preferably, metal eaves brackets are also provided.

15 Claims, 3 Drawing Sheets

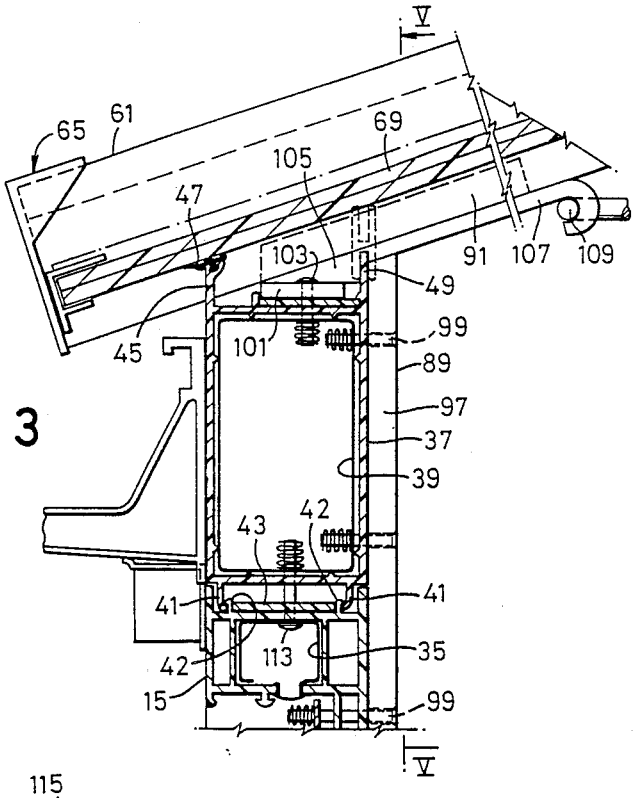
Fig. 3
Fig. 6
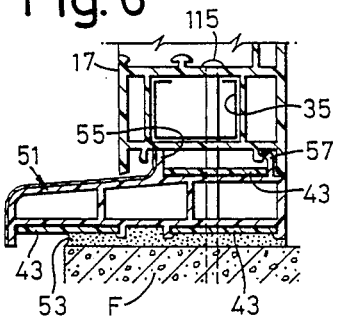
Fig. 4
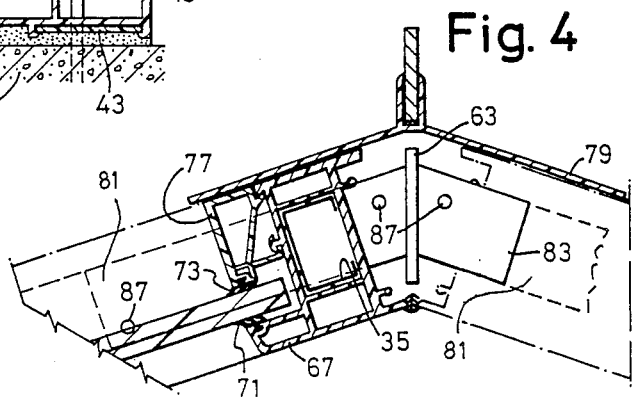

BUILDING STRUCTURE

This invention relates to a building structure and in particular to a structure for forming the framework of a conservatory or greenhouse and especially one where the frame members are made up of extruded sections, e.g. uPVC sections. It will be appreciated, however, that the structure could be used for supporting non-transparent panels, and the expression 'building structure' used herein should be interpreted accordingly.

At the moment, most conservatories having uPVC frames have insufficient strength where the extruded frame members are joined together.

Traditionally, uPVC conservatories are constructed with prefabricated modular wall panels and roof bars (although special shapes can be supplied on demand), transported to site and erected onto a prepared base by a professional assembly team. These components are mainly made from frame members of standard extruded uPVC sections strengthened with internal metal reinforcing, which are then joined together by traditional methods. The better conservatories incorporate metal tie bars and brackets inside the junction between every other roof bar and wall panel which are drilled and fixed with self-tapping screws. Structural Engineers have assumed that such constructions provide a rigid joint but it has now been found that even structures assembled in this way do not satisfy Building Regulations, since there is insufficient rigidity in the joints between roof bars and wall panels. Of course, some conservatories are being marketed by double glazing companies, where little thought has been given to structural rigidity and stability, and these are even less satisfactory.

One solution to this strength problem, with the larger conservatories, has been to install rigid "portal" steel frames within the conservatory at spaced locations. Such frames, however, are expensive and unsightly and are not popular with the majority of customers.

The present invention seeks to provide a conservatory construction which overcomes all the above-mentioned problems, satisfies Building Regulations, and also has the advantage that it can be assembled and erected by a D.I.Y. enthusiast.

As it is the metal reinforcing fixed inside the extruded uPVC frame members which provides the structural strength of a conservatory, the only way to calculate its performance is to apply the basic standards laid down for steel structures built on a 'Portal Frame' principle. This consists of two wall stanchions fixed at the bottom to a foundation and two sloping roof beams pinned together at the ridge and to the two stanchions at eaves level. (In the case of a conservatory, an adjustable tie rod would also normally be fitted to assist in erection but if all the joints between the members are properly made, it is not structurally necessary). It is the joints at the eaves and ridge which are the main points of weakness and to achieve the required rigidity each connection must be securely 'bolted' at least twice into each member on the line of rotation.

According to the present invention, we provide a building structure for providing a frame for a conservatory, said structure comprising two spaced rows of at least substantially upright extruded frame members defining spaced side walls of the building, at least one substantially horizontal beam joining the upper ends of the upright frame members in at least one of said rows, and a plurality of extruded roof bars extending between the upper ends of the frame members of one row and the opposed upper ends of the frame members of the other row, wherein at least selected ones of said upright extruded frame members and extruded roof bars are reinforced with metal reinforcement throughout their lengths and wherein said selected reinforced frame members and roof bars are connected together in such a manner as to provide a rigid connection at each joint, whereby one or more Portal Frames are provided in said structure.

Although it is envisaged that rivets or other fixing means, such as welding, could be used to join the frame members and roof bars to provide a rigid pinned joint, at least two bolts are preferably provided at each joint.

Preferably, the structure includes two rows of vertical frame members of the same height, the upper ends of each row being interconnected by an eaves beam, a ridge bar, and two sets of identical roof bars extending between the respective eaves beams and the ridge bar.

Preferably, each eaves beam is of extruded box section reinforced by an internal box section metal reinforcement, and each roof bar is also of box section and reinforced by a box section metal reinforcement.

Preferably, the ridge bar is a metal bar from which a plurality of opposed metal legs extend, the spacing of which corresponds with the spacing of the roof bars, every other pair of legs being longer than their adjacent pair of legs, said longer legs being dimensioned to fit snugly within the box section reinforcement of the selected roof bars and connected rigidly thereto with two bolts.

Preferably, further reinforced extruded frame members are fitted between roof bars adjacent and parallel to the ridge bar and an extruded ridge capping overlies the whole.

Preferably, where the roof bars join the eaves beam, a metal eaves bracket is provided, said bracket having a face plate which bolts to the inside face of the roof bar and to the reinforcement therein, and a similar face plate which bolts to the inside face of the eaves beam and the upright frame member and the reinforcements therein.

The wall face plate of the eaves bracket would look better and possibly have more strength fixed between the wall panels but this would involve cutting through and weakening the eaves plate. It has also proved difficult to fix the bolts in this position, particularly at the location H (FIG. 1) and after glazing they would be completely concealed so that no check or adjustment would be possible without de-glazing.

Preferably, the bracket includes a further plate which screws to the top of the eaves beam and reinforcement therein, and a stirrup connected to the roof bar, to receive a tie rod for connecting the eave of the conservatory to the opposite eave.

Preferably, each upright frame member is comprised of two upright window frame members clipped together and each incorporating reinforcement therein, to which reinforcements the face plate of the bracket is bolted.

A building structure forming part of the frame of a conservatory is now described by way of example with reference to the accompanying drawings, in which:

FIG. 3 is a full size, transverse vertical section at the point B in FIG. 1, showing how an eaves joint is formed;

FIG. 4 is a similar view to FIG. 3, but at the point A, showing how a ridge joint is formed;

FIG. 6 is a vertical transverse section at the point C in FIG. 2 showing how a wall of the conservatory is anchored at its lower end.

Figure 2:
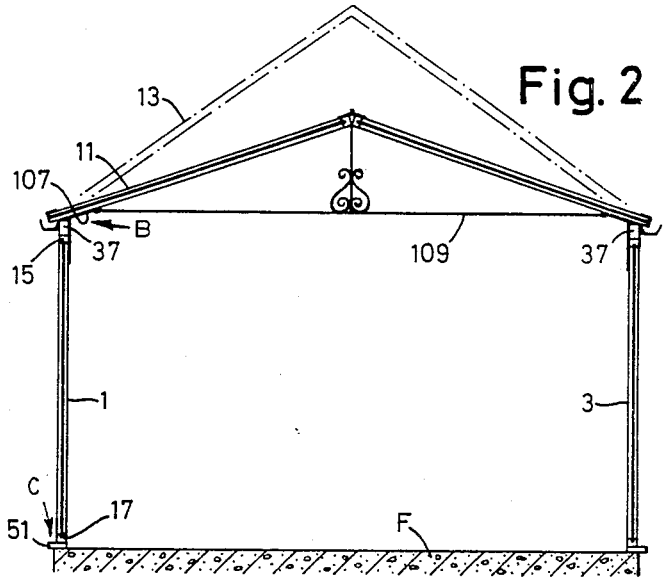
FIG. 2 is a partly schematic section on the line II—II of FIG. 1.
Figure 1:
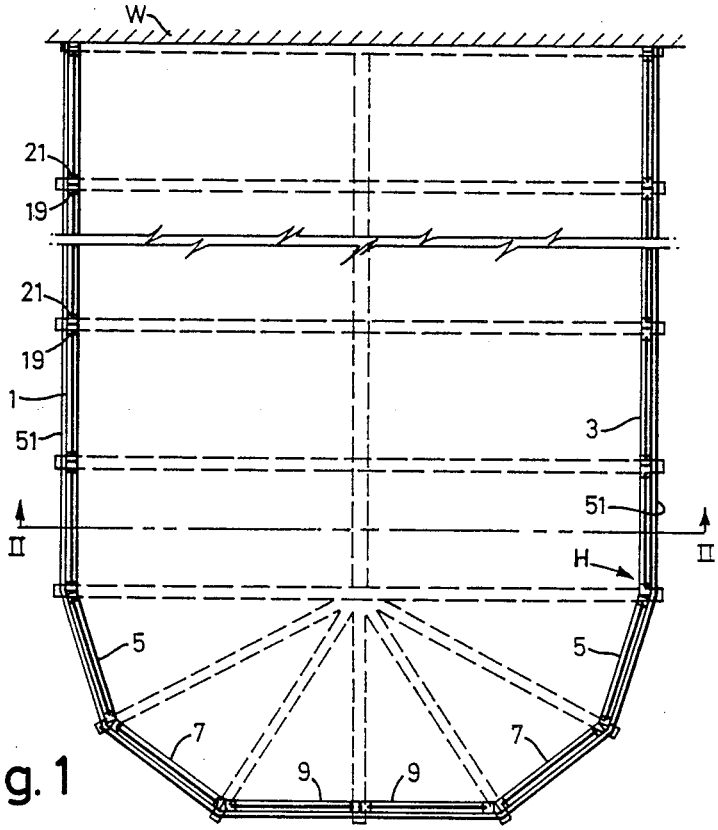
FIG. 1 is a partly schematic plan view of the conservatory.

Referring to FIGS. 1 and 2 of the drawings, the conservatory shown therein has opposed upright side walls 1 and 3, two end wall panels 5, two further end wall panels 7 and two yet further end wall panels 9 which together make up a dexagonal end, and a pitched roof which as a standard is either of 18° pitch as shown in full lines 11, or of 35° pitch as shown in broken lines 13. However, as a special, virtually any pitch can be constructed. As shown, the side walls 1 and 3 extend to ground level where they are fixed to a suitable foundation F, but they could equally easily be slightly shorter and be fixed to a dwarf wall. The conservatory can be of any chosen length and is shown abutting a wall W of a building. It can alternatively be constructed as a free standing structure with dexagonal end in place of abutment to a wall W.

Figure 5:
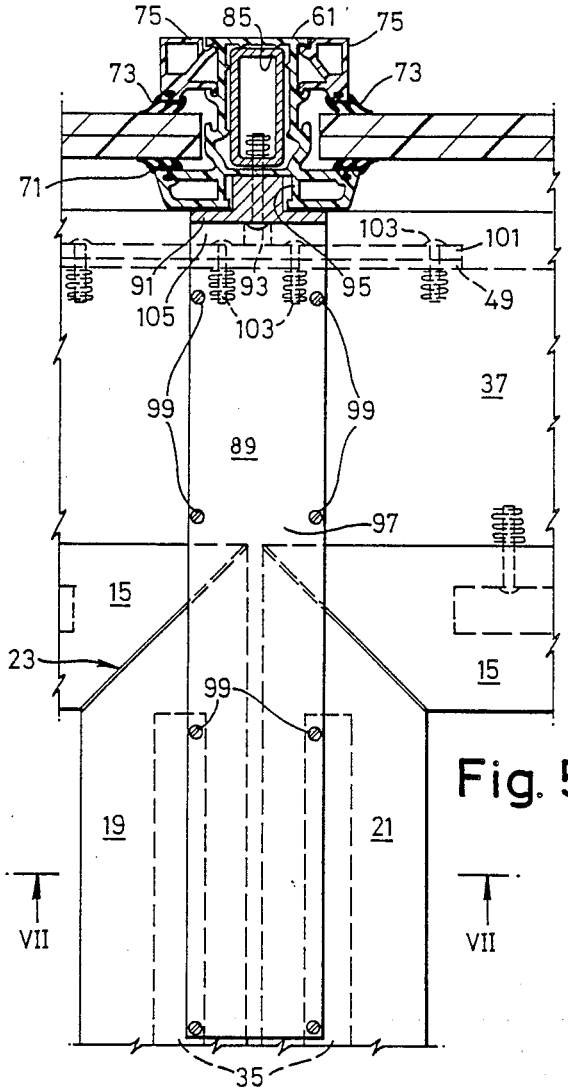
FIG. 5 is a longitudinal section, on the line V—V in FIG. 3, also at the point B in FIGS. 1 and 2.

The side walls 1 and 3 are made up of a plurality of rectangular glazed wall panels each comprised of an upper horizontal frame member 15 and a lower horizontal frame member 17 which are of identical cross-sectional construction and arranged as mirror images of each other as will hereinafter be described with reference to FIGS. 3 and 6, and a pair of horizontally spaced window frame members 19 and 21 which are of identical section to the members 15 and 17 (see FIG. 7). Where the respective frame members 15–21 abut at the corners of the frame, the members are mitred as shown at 23 in FIG. 5. (In the case of uPVC these joints are normally welded together but this is not essential). Suitable single, double or triple glazed panels 25 are located within the panel frames in known manner, one face of the panel 25 being sealed by a glazing gasket 27 and the other face by a gasket 29 located on the inner face of a clip-in glazing bead 31. As can be seen from FIG. 7, where the window frame member 19 of one glazed panel lies adjacent the window frame member 21 of the adjacent side wall panel, the two are clipped together using a purpose-made extruded snap-action vertical frame divider 33.

Figure 7:
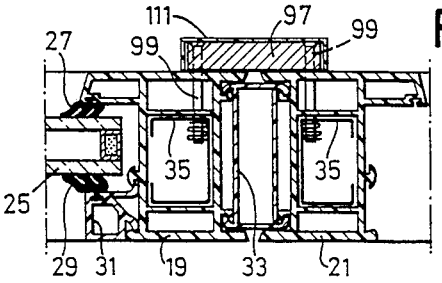
FIG. 7 is a horizontal section on the line VII—VII in FIG. 5.

As can be seen from FIGS. 3, 6 and 7, all of the window frame members 15, 17, 19 and 21 are of generally box section and they are formed from extruded uPVC or some other suitable synthetic resinous material and they are strengthened internally by a rolled galvanised steel C-sectioned reinforcement beam 35 running throughout their length.

The upper window frame members 15 are united along the whole length of the eave of the side wall by an extruded eaves beam 37 which itself is reinforced throughout its length by a rolled galvanised steel box-section beam 39. While the frame members 15–21 are of standard section such as is made by Profilia S.p.A of Italy, the eaves beam 37 is purpose made and on its lower edge is provided with resiliently deformable ribs 41 which form a snap fit with equivalent ribs 42 on the frame members 13. The various side wall panels are maintained in their adjacent upright relationship prior to fixing of the beam 37 thereon by short location plates 43 which are fixed between the ribs 42 and bridge the joints between adjacent panels. These may be either screwed or glued in place. Along its upper edge, the eaves beam 37 has an external flange 45 in the end face of which a gasket seal 47 is connected for forming a seal with the underside of the roof and along its inner edge is a further upstanding flange 49.

The lower frame members 17 of each adjacent side wall panel are united along their bottom edges by an extruded hollow sill plate 51 shown in detail in FIG. 6. If it is necessary to make a join in the sill plate 51, further synthetic resinous location plates 43 are used which form a snap-fit between projecting ribs on the upper and lower sides of the plate, as shown in FIG. 6. These may also be screwed or adhesively secured in position. The sill plate is bedded in known manner on the foundation F or dwarf wall using mastic or cement mortar 53 and the upper face of the sill plate is provided with locating ribs 55, 57, the latter forming a snap-fit connection with mating ribs on the underside of the frame member 17 as shown in FIG. 6.

The roof 11 (or 13) is formed from a plurality of extruded uPVC roof bars 61 (see FIG. 5) extending between a metal ridge bar 63 (see FIG. 4) and the respective eaves beams 37 but extending a little beyond the latter as shown at 65 in FIG. 3. The roof bars 61 are secured adjacent their lower ends to the eaves beams 37, and at their upper ends to the bar 63, as will hereinafter be described, and at their upper ends are interconnected by longitudinally extending extruded roof frame members 67 identical in cross-section with the frame members 15–21 and likewise, reinforced internally with reinforcement beams 35; the spacing of the roof bars 61 is arranged to coincide with that of the vertical window frame members defining each side wall panel or window frame. Suitable transparent polycarbonate or similar roofing sheets (or glass) 69 are supported by the roof bars 61 and frame members 67, there being suitable glazing gaskets 71 on the underside thereof supported respectively by flanges on the frame members 67 and roof bars 62 and further gaskets 73 on the upper side thereof supported by respective glazing beads 75 which form a snap-fit with the roof bars 61 and beads 77 which form a snap-fit with the frame members 67. It will of course be appreciated that the roof construction on the side of the ridge bar 63 remote from the frame member 67 shown in FIG. 4 is identical and will not therefore be described. A purpose-made extruded uPVC ridge capping strip 79 is located over the ridge bar 63 and frame members 67 as shown in FIG. 4 and secured in place with double sided self-adhesive tape or adhesive.

In accordance with the present invention the whole structure is strengthened considerably so that it will satisfy Building Regulations and be able to withstand substantial wind pressure, maximum snow loading and unequal loadings etc. without any fear of collapse. This is achieved by forming rigid joints at critical locations in the structure effectively converting selected frames and roof bars into Portal Frames.

Accordingly, the ridge bar 63 is provided throughout its length at spaced intervals with pairs of projecting metal legs 81, one leg of each pair extending from each side of the bar 63 (so that the legs of each pair are directly opposite each other), there being shorter pairs of directly opposed legs 83 located alternately with the longer legs 81. Each of the roof bars 61 incorporates a box section rolled galvanised steel reinforcement tube 85 therein and the dimensions of the legs 81 and 83 are such that they form a snug fit within the reinforcement tube 85. Each leg 81 and 83 is rigidly welded to the bar 63 and after the longer legs 81 have been inserted into the reinforcement tube 85 the roof bars 61 are rigidly bolted to the legs 83 through apertures 87 provided for the purpose in the legs 81, the bolts thus forming a rigid joint. Intermediate roof bars 61 are connected to the shorter legs 83 with only one bolt or screw.

At the eaves of the structure, each roof bar 61 which has been rigidly bolted to a longer leg 81 is rigidly secured to an upright frame member formed by the fixed-together window frame members 19 and 21 (see FIG. 7 and FIG. 1) and to the eaves beam 37. To achieve this rigid connection, an eaves bracket 89 is provided which will now be described in detail with reference to FIGS. 3, 4 and 5. The bracket 89 has a first face plate 91 of generally inverted T-shaped construction which is bolted to the roof bar reinforcing tube 85 with bolts 93 passing through the stem of the T (which locates in a longitudinal recess 95 cut out of the underside of the bar 61), through the plastics material of the bar 61 at least two spaced bolts 93 being used. Integral with the face plate 91 is a second face plate 97 which is secured by eight spaced bolts 99 to the upright frame member defined by the two adjacent window frame members 19 and 21 and to the eaves beam 37, the upper four bolts 99 passing through the beam 37 and into its box section reinforcement 39 and the four lower screws 99 passing through the uPVC material of the frame members 19 and 21 so that two engage with the C-sectioned reinforcement of the member 19 and two engage with the equivalent reinforcement of the member 21.

If the conservatory is to have the standard roof pitch of 18° then the plate 91 will form an angle of 108° with the plate 97, but if the roof has a 35° pitch, then the angle will be 125°. Angles for either roof pitches would be on similar principle. Integral with the two plates 91 and 97 but extending in a plane at right angles thereto is a further plate 101 which is so orientated as to overlie the eaves beam 37, this plate 101 being secured to the eaves beam 37 by four bolts 103 which extend through the uPVC material of the beam 37 into the box section reinforcement 39. Joins formed in the eaves beam 37 are located immediately above one of the side wall frame members 19, 21 so that a rigid joint can be achieved with the aid of the bracket 89. The bracket 89 also includes a web portion 105 connecting a central part of the plate 101 to the plate 91 for additional strength. A stirrup 107 extending up beneath the plate 91 and having a curved end portion secures the end of an eaves tie bar 109. A purpose-made uPVC extruded cover 111 overlies the plate 97 (this being an optional feature).

As can be seen from FIG. 3, the upper window frame members 15 are secured to the eaves beam 37 by bolts 113 which are accessible through a cappable access hole in the frame member 15 and pass through its reinforcement 35, the connector plate 43, the uPVC material of the beam 37 and into and through the reinforcement 39 of the eaves beam. Likewise, the lower window beam 17 is rigidly secured to the sill plate 51 and foundation F or dwarf wall on which the whole structure rests by anchor bolts 115 which pass through the reinforcement 35 of the member 17 and through numerous other layers of uPVC material and into the foundation F or dwarf wall.

In the preferred construction, each alternate frame has all its joints in the form of rigid joints such as have been described above, thus forming a portal frame, with adjacent frames incorporating joints of a less rigid nature. For example, whereas the upper ends of the roof bars are connected with single bolts to the shorter legs 83 on the ridge bar 63, the lower ends are connected to the ridge beam 37 with screws passing through the glazing flanges on the bar 61. Of course, each of the adjacent frames which is a portal frame is rigidly connected to its adjacent frame and to the next portal frame and/or the other frames and portal frames through the rigid ridge bar and eaves beams and through the sill plates 51 thus producing an absolutely rigid structure which will satisfy Building Regulations.

There are various other features of the conservatory which are new, such as the purpose-made uPVC capping for the lower ends of the roof bars 61, the purpose-made uPVC Dentil moulding, curved bars for the upper portions of the side wall panels, and the special shaped connectors for joining together the end wall panels 5, 7 and 9, but all these and other component parts of the conservatory are illustrated in the accompanying drawings and need not be described in detail.

It will of course be understood that the present invention has been described above purely by way of example, and modifications of detail can be made within the scope of the invention.

I claim:

1. A building structure for providing a frame for a conservatory, comprising:

two spaced rows of at least substantially upright extruded frame members defining spaced side walls of the building;

at least one substantially horizontal beam joining upper ends of the upright frame members in at least one of said rows;

a plurality of extruded roof bars extending between the upper ends of the frame members of one row and opposed upper ends of the frame members of the other row;

wherein at least selected ones of said upright extruded frame members and extruded roof bars comprise metal reinforcement means extending throughout their lengths; and structural connecting means connected between said selected reinforced frame members and roof bars for providing a rigid connection at each joint, to form one or more Portal Frames in said structure.

2. A building structure according to claim 1 comprising at least two bolts fastening each reinforced frame member and each roof bar to said structural connecting means at each joint.

3. A building structure according to claim 1 wherein the structure comprises two rows of vertical frame members of the same height;

two eaves beams, one attached to the upper ends of the frame members of each row;

a ridge bar; and two sets of identical roof bars extending between the respective eaves beams and the ridge bar.

4. A building structure according to claim 3 wherein each eaves beam comprises an extruded box section and an internal box section metal reinforcement, and each roof bar comprises a box section and a box section metal reinforcement.

5. A building structure according to claim 3 wherein the ridge bar comprises a metal bar having a plurality of opposed metal legs extending laterally therefrom, the spacing of which corresponds with the spacing of the roof bars, every other pair of legs being longer than their adjacent pair of legs, said longer legs being dimensioned to fit snugly within the box section reinforcement of the selected roof bars and connected rigidly thereto with two bolts.

6. A building structure according to claim 3, comprising reinforced extruded frame members disposed between adjacent ones of the roof bars, adjacent and parallel to the ridge bar; and an extruded ridge capping overlies the ridge bar.

7. A building structure according to claim 3 comprising a metal eaves bracket having a face plate bolted to an inside face of the roof bar and to the reinforcement therein, and a second face plate bolted to an inside face of the eaves beam and the upright frame member and the reinforcements therein.

8. A building structure according to claim 3 wherein the bracket comprises a further plate screwed to the top of the eaves beam and the reinforcement therein, and further comprising a stirrup connected to the roof bar, and a tie rod connecting an eave of the conservatory to an opposite eave.

9. A building structure according to claim 7 wherein each upright frame member comprises two upright window frame members clipped together and each incorporating reinforcement means therein, to which reinforcement means the face plate of the bracket is bolted.

10. A building structure for providing a frame for a conservatory comprising:

a metal ridge bar having a plurality of opposed metal legs extending therefrom in oppositely directed pairs, every other pair of legs being longer than their adjacent pairs of legs;

a plurality of extruded roof bars, each roof bar having a generally box shaped section and comprising a box shaped metal reinforcing member;

each of the roof bars being attached at a first end thereof to one of the legs of the metal ridge bar, the legs of the longer pairs of opposed metal legs having dimensions to fit snugly within the box section reinforcement of corresponding roof bars and connected rigidly thereto;

two rows of vertical frame members having upper ends arranged in two rows;

at least one substantially horizontal beam attached to the upper ends of the vertical frame members in each said rows;

at least selected ones of the vertical frame members comprising metal reinforcement means extending throughout their lengths; and a plurality of structural connecting means for joining selected reinforced frame members and selected ones of said roof bars for providing a rigid connection at each joint to form one or more portal frames in said structure.

11. A building structure for providing a frame for a conservatory comprising:

two rows of vertical frame members having upper ends arranged in a row for defining spaced sidewalls of the building;

at least one substantially horizontal eaves beam joining the ends of the frame members in each row;

a ridge bar;

two sets of extruded roof bars extending between the eaves beams and the ridge bar at the locations where each of the vertical frame members is attached to the eaves beam;

a plurality of metal eaves brackets, each bracket having a first face plate attached to an inside face of each roof bar and to the metal reinforcing means thereof, and a second face plate attached to an inside face of the eaves beam and to a vertical frame member, and the reinforcing means thereof.

12. A building structure for providing a frame for a conservatory, comprising:

two spaced rows of at least substantially upright extruded frame members defining spaced sidewalls of the building;

at least one substantially horizontal beam joining upper ends of the upright frame members in at least one of said rows;

a plurality of extruded roof bars extending between the upper ends of the frame members of one row and opposed upper ends of the frame members of the other row;

wherein at least selected ones of said upright extruded frame members and extruded roof bars comprise metal reinforcement means extending throughout their lengths; and structural connecting means connected between said selected reinforced frame members and roof bars for providing a rigid connection between the metal reinforcing means at each joint, to form one or more Portal Frames in said structure.

13. A building structure according to claim 12 comprising at least two bolts fastening the reinforcement means of each reinforced frame member and the reinforcement means of each roof bar to said structural connecting means at each joint.

14. A building structure according to claim 12 wherein the structure comprises two rows of vertical frame members of the same height;

two eaves beams, one attached to the upper ends of the frame members of each row;

a ridge bar; and two sets of identical roof bars extending between the respective eaves beams and the ridge bar.

15. A building structure according to claim 14 werein each eaves beam comprises an extruded box section and an internal box section metal reinforcement, and each roof bar comprises a box section and a box section metal reinforcement.

* * * * *